US007956753B2

(12) United States Patent
Fogg

(10) Patent No.: US 7,956,753 B2
(45) Date of Patent: Jun. 7, 2011

(54) TETHER APPARATUS

(75) Inventor: Benjamin Fogg, Holland, MI (US)

(73) Assignee: Fogg Filler Company, Holland, MI (US)

( * ) Notice: Subject to any disclaimer, the term of this patent is extended or adjusted under 35 U.S.C. 154(b) by 148 days.

(21) Appl. No.: 12/151,368

(22) Filed: May 6, 2008

(65) Prior Publication Data

US 2009/0278694 A1 Nov. 12, 2009

(51) Int. Cl.
*G08B 23/00* (2006.01)

(52) U.S. Cl. ..... 340/573.1

(58) Field of Classification Search ..... 340/573.1, 340/539.13, 539.15, 573.4, 636.2, 645; 36/132
See application file for complete search history.

(56) References Cited

U.S. PATENT DOCUMENTS

| | | | | |
|---|---|---|---|---|
| 3,673,444 | A | 6/1972 | Kawabe et al. | |
| 4,385,246 | A | 5/1983 | Schur et al. | |
| 4,457,148 | A | 7/1984 | Johansson et al. | |
| 4,500,827 | A | 2/1985 | Merritt et al. | |
| 4,802,353 | A | 2/1989 | Corder et al. | |
| 4,854,143 | A | 8/1989 | Corder et al. | |
| 5,089,734 | A | 2/1992 | Bickraj | |
| 5,167,082 | A | 12/1992 | Chen | |
| 5,206,897 | A | 4/1993 | Goudreau et al. | |
| 5,347,186 | A | 9/1994 | Konotchick | |
| 5,495,682 | A * | 3/1996 | Chen | 36/2.6 |
| 5,608,279 | A | 3/1997 | Murray | |
| 5,631,507 | A | 5/1997 | Bajric et al. | |
| 5,828,306 | A | 10/1998 | Curran | |
| 5,892,454 | A | 4/1999 | Schipper et al. | |
| 5,905,461 | A | 5/1999 | Neher | |
| 6,014,080 | A | 1/2000 | Layson, Jr. | |
| 6,127,931 | A | 10/2000 | Mohr | |
| 6,255,799 | B1 * | 7/2001 | Le et al. | 320/107 |
| 6,362,778 | B2 | 3/2002 | Neher | |
| 6,388,612 | B1 | 5/2002 | Neher | |
| 6,529,131 | B2 | 3/2003 | Wentworth | |
| 6,639,516 | B1 | 10/2003 | Copley | |
| 6,717,297 | B2 | 4/2004 | Sadarangani et al. | |
| 6,794,783 | B2 | 9/2004 | Tu et al. | |
| 6,824,176 | B2 | 11/2004 | Spurr et al. | |
| 6,967,562 | B2 | 11/2005 | Menard et al. | |
| 7,070,212 | B2 | 7/2006 | Spurr | |
| 7,113,070 | B2 | 9/2006 | Deng et al. | |
| 2007/0193070 | A1 * | 8/2007 | Bertagna et al. | 36/132 |

* cited by examiner

*Primary Examiner* — Phung Nguyen
(74) *Attorney, Agent, or Firm* — King & Partners, PLC

(57) ABSTRACT

A tether apparatus having a housing which includes a cavity, and further wherein the housing is adapted for association with a user; a securement member, wherein the securement member is associated with at least a portion of the housing; and a tracking sub-assembly having a communication member, wherein the communication member is at least partially positioned within the housing and wherein the communication member transmits a position signal; an energy storage device, wherein the energy storage device is at least partially positioned within the housing and/or a user's footwear and wherein the energy storage device electrically communicates with the communication member; and a kinetic energy charger, wherein the kinetic energy charger is at least partially positioned within at least one of the housing and a user's footwear and wherein the kinetic energy charger electrically communicates with at least one of the communication member and the energy storage device.

20 Claims, 3 Drawing Sheets

TETHER APPARATUS

CROSS-REFERENCE TO RELATED APPLICATION(S)

Not Applicable

BACKGROUND OF THE INVENTION

1. Field of the Invention

The present invention relates in general to a tether apparatus and, more particularly, to a tether apparatus which reduces the need for maintenance of the same.

2. Background Art

Tether apparatuses have been known in the art for years and are the subject of numerous patents including: U.S. Pat. No. 6,639,516, entitled "Personal Tracking Device," U.S. Pat. No. 6,529,131, entitled "Electronic Tether," U.S. Pat. No. 6,388,612, entitled "Global cellular position tracking device," U.S. Pat. No. 6,362,778, entitled "Personal location detection system," U.S. Pat. No. 6,127,931, entitled "Device for monitoring the movement of a person," U.S. Pat. No. 6,014,080, entitled "Body worn active and passive tracking device," U.S. Pat. No. 5,905,461, entitled "Global positioning satellite tracking device," U.S. Pat. No. 5,892,454, entitled "Hybrid monitoring of location of a site confinee," U.S. Pat. No. 5,828,306, entitled "Location detector and monitor and method of using the same," and U.S. Pat. No. 5,206,897, entitled "Home incarceration system"—all of which are hereby incorporated herein by reference in their entirety including the references cited therein.

In addition, various approaches have been taken toward the development of kinetic energy chargers and include those disclosed in U.S. Pat. No. 6,794,783, entitled "Flat rotary electric generator," U.S. Pat. No. 6,717,297, entitled "Electrical machine," U.S. Pat. No. 6,255,799, entitled "Rechargeable Shoe," U.S. Pat. No. 5,631,507, entitled "Electric power generator," U.S. Pat. No. 5,608,279, entitled "DC generator," U.S. Pat. Nos. 5,495,682 and 5,167,082, entitled "Dynamoelectric Shoes," U.S. Pat. No. 5,347,186, entitled "Linear motion electric power generator," U.S. Pat. No. 5,089,734, entitled "Dual rotary AC generator," U.S. Pat. No. 4,500,827, entitled "Linear reciprocating electrical generator," U.S. Pat. No. 4,385,246, entitled "Apparatus for producing electrical energy," and U.S. Pat. No. 3,673,444, entitled "Rotary electric machine"—all of which are hereby incorporated herein by reference in their entirety including the references cited therein.

While tether apparatuses and monitoring devices have been known in the art for years, issues associated with energy consumption, battery life, and assembly maintenance remain problematic. To be sure, a substantial amount of time must be dedicated to recharging presently available tether apparatuses—especially with regard to a user wearing the tether who may lack the ability to properly charge the tether. Also, conventional tethers may require the replacement of primary electrochemical cells which increases inefficiency. For example, current tethers and/or monitors require that the individual wearing the tether recharge the unit at a docking/base station, or through a typical wall plug electrical charger such as those used by cellular phones. These methods are inconvenient if the user needs to be away from the base for a substantial period of time or has forgotten necessary charging equipment.

Therefore, it is an object of the present invention to provide a tether apparatus having one or more kinetic energy chargers to reduce and/or eliminate the aforementioned drawbacks associated with presently available tether apparatuses.

These and other objects of the present invention will become apparent in light of the present specification, claims, and drawings.

SUMMARY OF THE INVENTION

In one embodiment of the present invention, a tether apparatus is disclosed as comprising: (a) a housing, wherein the housing comprises a cavity, and further wherein the housing is adapted for association with a user; (b) a securement member, wherein the securement member is associated with at least a portion of the housing; and (c) a tracking sub-assembly which comprises; (1) a communication member, wherein the communication member is at least partially positioned within the housing, and wherein the communication member transmits a position signal; (2) an energy storage device, wherein the energy storage device is at least partially positioned within the housing and/or a user's footwear, and wherein the energy storage device electrically communicates with the communication member; and (3) a kinetic energy charger, wherein the kinetic energy charger is at least partially positioned within at least one of the housing and a user's footwear and further wherein the kinetic energy charger electrically communicates with the communication member and/or the energy storage device.

In a preferred embodiment of the present invention, the tracking sub-assembly further comprises a rectifier, wherein the rectifier is at least partially positioned within the housing.

In another preferred embodiment of the present invention, the kinetic energy charger comprises at least one linear kinetic energy charger, vibrational kinetic energy charger, torsional kinetic energy charger, and/or compressional kinetic energy charger.

In yet another preferred embodiment of the present invention, the kinetic energy charger comprises a linear kinetic energy charger, a vibrational kinetic energy charger, and/or a torsional kinetic energy charger associated with the housing and/or a compressional kinetic energy charger associated with a user's footwear. In such an embodiment, the compressional kinetic energy charger preferably electrically communicates with the communication member and/or the energy storage device of the tether apparatus.

In a preferred embodiment of the present invention, the kinetic energy charger consists of a vibrational kinetic energy charger associated with the housing and a compressional kinetic energy charger associated with a user's footwear.

In another preferred embodiment of the present invention, the housing comprises, a first wall, a second wall, a third wall and a fourth wall, wherein the first and second walls are spaced apart from one another, and the third and fourth walls are spaced apart from one another to define a substantially polygonal cavity. In this embodiment, the first wall, the second wall, the third wall, the fourth wall, a cap, and a base cooperate to preferably form a watertight housing for containing the communication member, the energy storage device, and/or the kinetic energy charger.

In yet another preferred embodiment of the present invention, the securement member comprises a loop of elastomeric material attached to the housing which is releasably securable to a user. Alternatively, the securement member may comprise: (1) a first strap, wherein the first strap comprises: a first tab; and a second tab; (2) a second strap, wherein the second strap comprises a first tab; and a second tab; and (3) wherein the first tab of the first strap and the first tab of the second strap are attached to at least a portion of the housing, and wherein the second tab of the first strap comprises a series of hooks, and the second tab of the second strap comprises a series of loops, and further wherein the second tab of the first strap and the second tab of the second strap cooperate and provide releasable securement of the tether apparatus to at least a portion of a user.

In accordance with the present invention, the communication member preferably comprises an active radio frequency identification device and/or a global positioning system which emits/transmits the position signal.

In a preferred embodiment of the present invention, the communication member transmits the position signal to a monitor via a wireless communication system, a telephonic communication system, and/or a computer network system.

In another preferred embodiment of the present invention, the energy storage device comprises a primary electrochemical cell, a secondary electrochemical cell, and/or a capacitor. Preferably, the secondary electrochemical cell comprises an alkaline, a lead acid, a nickel-cadmium, a nickel metal hydride, a lithium-ion, and/or a lithium ion polymer secondary electrochemical cell.

In yet another preferred embodiment of the present invention, the energy storage device indirectly and/or directly communicates alternating current and/or direct current to the communication member.

In an additional preferred embodiment of the present invention, the kinetic energy charger converts kinetic energy of the linear, vibrational, compressional and/or rotational movements of a user wearing the tether apparatus into alternating current and/or direct current.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein.

DETAILED DESCRIPTION OF THE INVENTION

Figure 1:
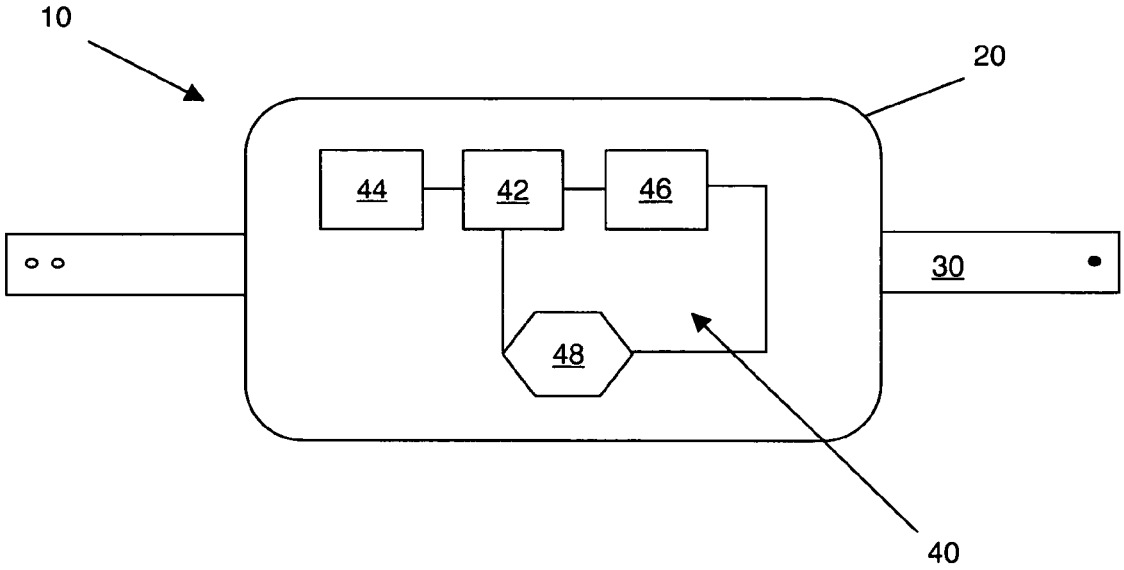
FIG. 1 of the drawings is a fragmented, top plan view of a tether apparatus fabricated in accordance with the present invention.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings and to FIG. 1 in particular, a fragmented, top plan view of tether apparatus 10 is shown as generally comprising housing 20, securement member 30, and tracking sub-assembly 40.

Housing 20 may comprise, for example, a first wall, a second wall, a third wall and fourth wall, where the first and second walls are spaced apart from one another, and the third and fourth walls are spaced apart from one another to define a substantially polygonal cavity for housing tracking sub-assembly 40. For purposes of the present disclosure, the first wall, the second wall, the third wall, the fourth wall, cap 50 (FIG. 3), and base 60 (FIG. 3) may cooperate to form a watertight housing for containing tracking sub-assembly 40, and an optional rectifier 48. It will be understood that housing 20 may comprise any one of a number of geometric configurations that are operably functional with an associated user's body, or portion thereof. Also, for purposes of the present disclosure, housing 20 is preferably fabricated from a natural and/or synthetic plastic resin, metals, wood, etcetera. However, any one of a number of materials that would be known to those having ordinary skill in the art with the present disclosure before them are likewise contemplated for use. Housing 20 may preferably be manufactured from a waterproof material, thereby protecting the contents of the housing from the elements, or other outside contaminates.

In one embodiment of the present invention, tether apparatus further comprises securement member 30 which is shown as connected to at least a portion of housing 20. Securement member 30 may preferably be attached to housing 20 using a variety of different fasteners including, but not limited to, screws, rivets, bolts, adhesives, hook and loop arrangements—just to name a few. In one embodiment, securement member 30 may comprise a loop of elastomeric material, for example a rubber, where the elastomeric material is deflectable enough to slip over the hand or foot of a user and will return to its original shape to secure tether apparatus 10 around at least a portion of the user (e.g. a hand or a foot). It will be understood that any one of a number of materials that would be known to those having ordinary skill in the art with the present disclosure before them are likewise contemplated for use.

By way of another example, securement member 30 may comprise a pair of straps with securement regions. The first strap preferably comprises a first tab and a second tab. Likewise, the second strap preferably comprises a first tab and a second tab. The first tab of the first strap and the first tab of the second strap are attached to at least a portion of housing 20. Also, the second tab of the first strap may comprise a series of hooks, and the second tab of the second strap comprises a series of loops. In operation, the second tab of the first strap and the second tab of the second strap cooperate to provide releasable securement of tether apparatus 10 to at least a portion of a user. Though this embodiment discloses hook and loop fasteners, any suitable releasable attachment means may be used, including but not limited to, a snapping type fastener, a button and loop, or a zipper—only to name a few.

In accordance with the present disclosure, tether apparatus 10 preferably comprises tracking sub-assembly 40, which generally comprises kinetic energy charger 42, communication member 44, energy storage device 46 and optional rectifier 48.

Kinetic energy charger 42 converts the kinetic energy of an associated user/individual into an electrical current. (i.e. direct current and/or alternating current). In one embodiment of the present invention, kinetic energy charger 42 is at least partially positioned within housing 20. Kinetic energy may preferably be converted from linear, torsional, vibrational and/or compressional motion of a user wearing tether apparatus 10. Kinetic energy charger 42 may comprise, for example, a linear kinetic energy charger, a compressional kinetic energy charger, a vibrational kinetic energy charger, or a torsional kinetic energy charger. Preferably, kinetic energy charger 42 will comprise a combination of all the aforementioned kinetic energy chargers to take advantage of all the various types of kinetic energy produced by the individual wearing tether apparatus 10.

In one embodiment of the present invention, movements made by the individual wearing tether apparatus 10 will move a rotor within a stator, or a plurality of rotors and stators inside kinetic energy charger 42, or a rotor around a stator inside the kinetic energy charger 42. When the rotor is moved within or around a stator it produces either direct and/or alternating current. This direct and/or alternating current is preferably communicated to energy storage device 46, or to communication member 44 as will be discussed in greater detail infra.

In another aspect of the present invention, kinetic energy charger 42 converts the kinetic energy of a user immediately into direct current. In another embodiment of the present invention, kinetic energy charger 42, converts the kinetic energy of a user into alternating current. If kinetic energy charger 42 converts the kinetic energy to alternating current, then tracking sub-assembly 40 may preferably further comprise rectifier 48. It will be understood that rectifier 48 is at least partially positioned within housing 20, and converts alternating current produced by kinetic energy charger 42 into direct current.

In accordance with the present disclosure, tracking sub-assembly 40 is shown as further comprising energy storage device 46. Energy storage device 46 may comprise a combination of a primary electrochemical cell, a secondary electrochemical cell and/or a capacitor.

Secondary electrochemical cells preferably comprise at least one of an alkaline, a lead acid, a nickel-cadmium, a nickel metal hydride, a lithium-ion, and a lithium ion polymer secondary electrochemical cell.

In one embodiment of the present invention, energy storage device 46 receives direct current from rectifier 48. In another embodiment, energy storage device 46 receives direct current from kinetic energy charger 42.

Referring again to FIG. 1, tracking sub-assembly 40 is shown as further comprising communication member 44. Communication member 44 is preferably powered by energy storage device 46. In one embodiment of the present invention, communication member 44 preferably comprises an active radio frequency identification device which transmits a position signal. Alternatively, communication member 44 may comprise a global positioning system which transmits a position signal.

In accordance with the present disclosure, communication member 44 preferably transmits a position signal via either a global positioning system, or an active radio frequency identification device to monitor 70. Communication member 44 transmits position signals to monitor 70 via at least one of a wireless communication system (e.g. cellular and/or satellite), a telephonic communication system, a computer network system or any combination of the aforementioned systems.

Figure 2:
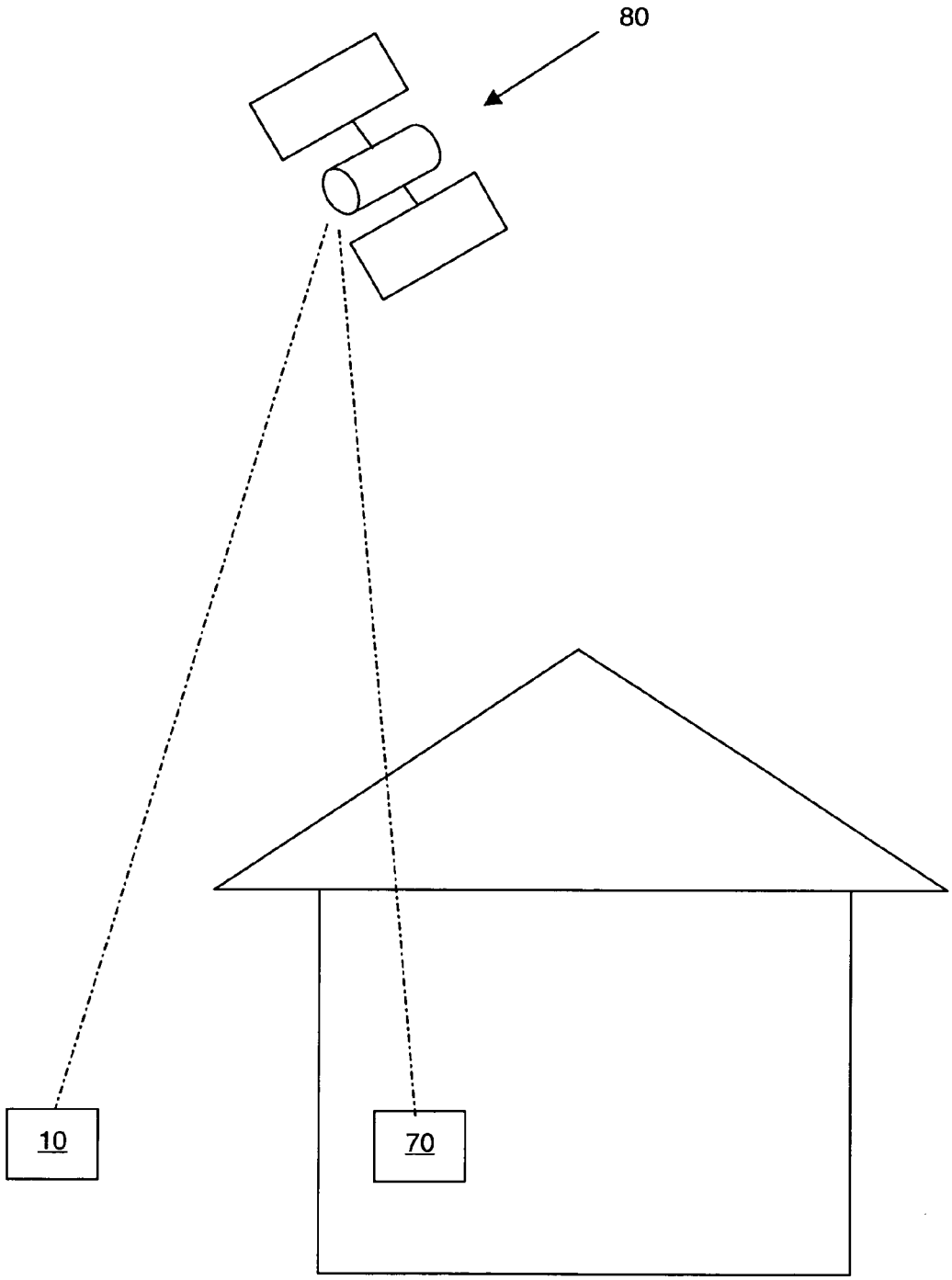
FIG. 2 of the drawings is a schematic representation of a tether apparatus and associated satellite communication system.

As is best shown in FIG. 2, tether apparatus 10 preferably transmits a position signal to monitor 70 via a wireless communications system 80, which, in this embodiment comprises a satellite transmission system.

In accordance with the present disclosure, monitor 70 may preferably comprise a hand-held global position receiver, a standard computer system, or even a cellular telephone. Monitor 70 tracks the position of an associated user who has been fitted with tether apparatus 10.

Figure 3:
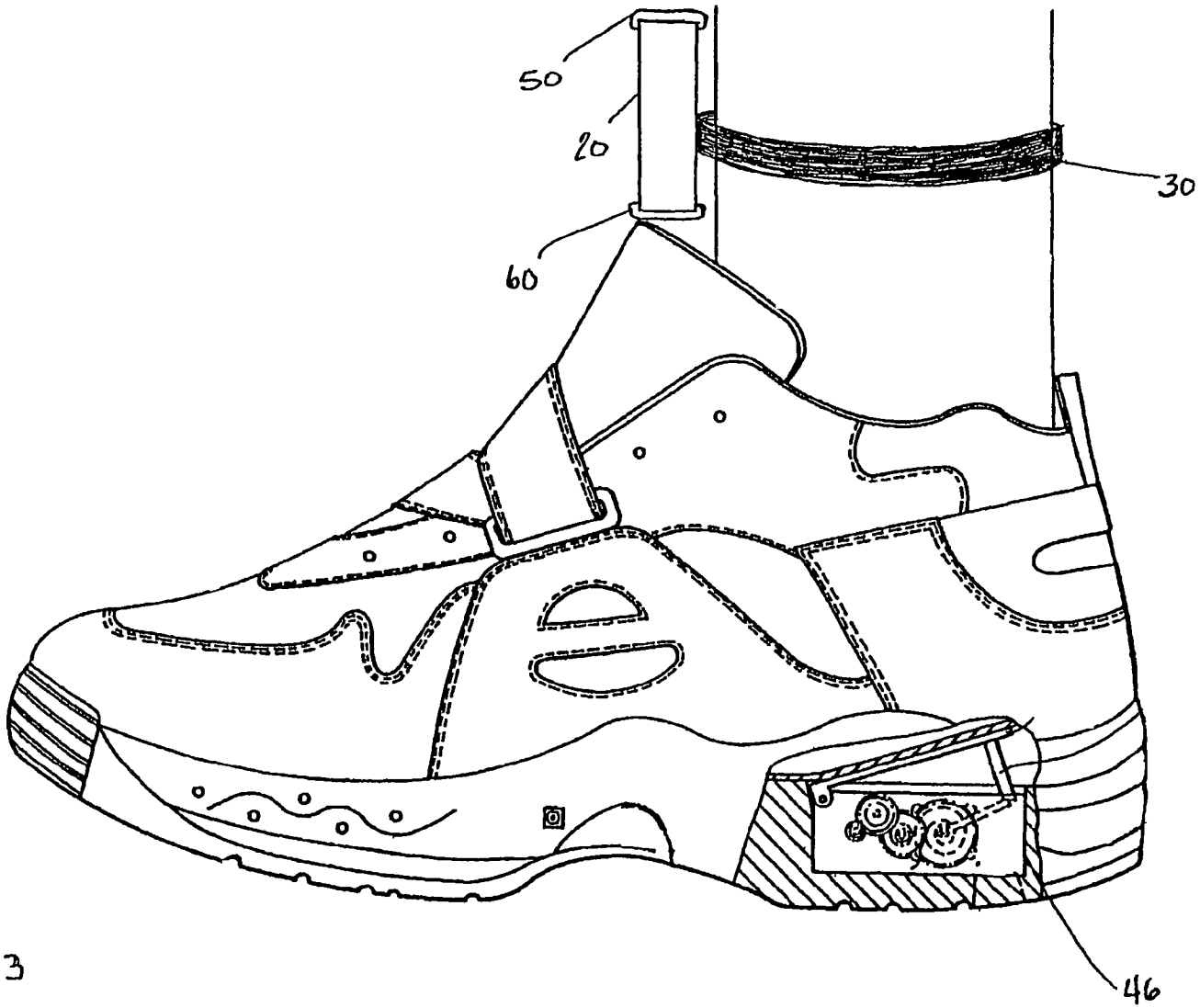
FIG. 3 of the drawings is a side elevational view of a tether apparatus fabricated in accordance with the present invention shown secured to/about a user.

Referring now to FIG. 3, which is a side elevation view of tether apparatus 10 shown secured about a user. Kinetic energy produced by vertical, horizontal, compressional, or erratic movements of a user's foot are converted to either direct current or alternating current via kinetic energy charger 42 associated with a user's footwear. In particular, compressional movements, as when a user's foot impacts the ground, generate kinetic energy which linear kinetic energy charger 42 preferably converts into an electrical current, either direct and/or alternating. The direct and/or alternating current is then preferably converted and/or stored as previously discussed supra.

Referring now to FIGS. 1, 2 and 3 collectively, in operation, tether apparatus 10 is releaseably attached to at least a portion of an associated user. Kinetic energy chargers 42 associated with both the housing and a user's footwear convert compressional, vibrational, linear and/or torsional movement into direct current. Next, kinetic energy charger 42 communicates direct current to energy storage device 46. At any time, energy storage device 46 preferably communicates energy to communication member 44 using previously stored and/or concurrently produced direct current. Finally, communication member 44, which in this preferred embodiment comprises a global positioning system, transmits a position signal via wireless communications system 80, which is received by monitor 70.

The foregoing description merely explains and illustrates the invention and the invention is not limited thereto except insofar as the appended claims are so limited, as those skilled in the art who have the disclosure before them will be able to make modifications without departing the scope of the invention.

What is claimed:

1. A tether apparatus, comprising:

a housing, wherein the housing comprises a cavity, and further wherein the housing is adapted for association with a user;

a securement member, wherein the securement member is associated with at least a portion of the housing; and a tracking sub-assembly which comprises;

a communication member, wherein the communication member is at least partially positioned within the housing, and wherein the communication member transmits a position signal;

an energy storage device, wherein the energy storage device is at least partially positioned within at least one of the housing and a user's footwear, and wherein the energy storage device electrically communicates with the communication member; and a kinetic energy charger, wherein the kinetic energy charger is at least partially positioned within at least one of the housing and a user's footwear and further wherein the kinetic energy charger electrically communicates with at least one of the communication member and the energy storage device.

2. The tether apparatus according to claim 1, wherein the tracking sub-assembly further comprises a rectifier, wherein the rectifier is at least partially positioned within the housing.

3. The tether apparatus according to claim 1, wherein the kinetic energy charger comprises at least one linear kinetic energy charger.

4. The tether apparatus according to claim 1, wherein the kinetic energy charger comprises at least one vibrational kinetic energy charger.

5. The tether apparatus according to claim 1, wherein the kinetic energy charger comprises at least one torsional kinetic energy charger.

6. The tether apparatus according to claim 1, wherein the kinetic energy charger comprises at least one compressional kinetic energy charger.

7. The tether apparatus according to claim 1, wherein the kinetic energy charger comprises at least one of a linear kinetic energy charger, a vibrational kinetic energy charger, and a torsional kinetic energy charger associated with the housing and a compressional kinetic energy charger associated with a user's footwear.

8. The tether apparatus according to claim 7, wherein the compressional kinetic energy charger electrically communicates with at least one of the communication member and the energy storage device of the tether apparatus.

9. The tether apparatus according to claim 1, wherein the kinetic energy charger consists of a vibrational kinetic energy charger associated with the housing and a compressional kinetic energy charger associated with a user's footwear.

10. The tether apparatus according to claim 1, wherein the housing comprises, a first wall, a second wall, a third wall and a fourth wall, wherein the first and second walls are spaced apart from one another, and the third and fourth walls are spaced apart from one another to define a substantially polygonal cavity.

11. The tether apparatus according to claim 10, wherein the first wall, the second wall, the third wall, the fourth wall, a cap, and a base cooperate to form a water-tight housing for containing at least one of the communication member, the energy storage device, and the kinetic energy charger.

12. The tether apparatus according to claim 1, wherein the securement member comprises a loop of elastomeric material attached to the housing which is releasably securable to a user.

13. The tether apparatus according to claim 1, wherein the securement member further comprises:

a first strap, wherein the first strap comprises:

a first tab; and a second tab;

a second strap, wherein the second strap further comprises a first tab; and a second tab;

wherein the first tab of the first strap and the first tab of the second strap are attached to at least a portion of the housing, and wherein the second tab of the first strap comprises a series of hooks, and the second tab of the second strap comprises a series of loops, and further wherein the second tab of the first strap and the second tab of the second strap cooperate and provide releasable securement of the tether apparatus to at least a portion of a user.

14. The tether apparatus according to claim 1, wherein the communication member comprises an active radio frequency identification device which transmits the position signal.

15. The tether apparatus according to claim 1, wherein the communication member comprises a global positioning system which transmits the position signal.

16. The tether apparatus according to claim 1, wherein the communication member transmits the position signal to a monitor via at least one of a wireless communication system, a telephonic communication system, and a computer network system.

17. The tether apparatus according to claim 1, wherein the energy storage device comprises at least one of a primary electrochemical cell, a secondary electrochemical cell, and a capacitor.

18. The tether apparatus according to claim 17, wherein the energy storage device communicates at least one of alternating current and direct current to the communication member.

19. The tether apparatus according to claim 17, wherein the secondary electrochemical cell comprises at least one of an alkaline, a lead acid, a nickel-cadmium, a nickel metal hydride, a lithium-ion, and a lithium ion polymer secondary electrochemical cell.

20. The tether apparatus according to claim 1, wherein the kinetic energy charger converts kinetic energy of at least one of linear, vibrational, compressional and rotational movements of a user wearing the tether apparatus into at least one of alternating current and direct current.

* * * * *